US009404341B2

(12) United States Patent
Williams

(10) Patent No.: US 9,404,341 B2
(45) Date of Patent: Aug. 2, 2016

(54) RELEASE TOOL FOR A DRILL STRING INSIDE BLOWOUT PREVENTER

(71) Applicant: DWJ Inc., Lafayette, LA (US)

(72) Inventor: Donald L. Williams, Lafayette, LA (US)

(73) Assignee: DWJ Inc., Lafayette, LA (US)

( * ) Notice: Subject to any disclaimer, the term of this patent is extended or adjusted under 35 U.S.C. 154(b) by 153 days.

(21) Appl. No.: 14/464,663

(22) Filed: Aug. 20, 2014

(65) Prior Publication Data

US 2015/0068768 A1 Mar. 12, 2015

Related U.S. Application Data

(60) Provisional application No. 61/875,910, filed on Sep. 10, 2013, provisional application No. 61/896,208, filed on Oct. 28, 2013, provisional application No. 61/983,378, filed on Apr. 23, 2014.

(51) Int. Cl.

| | |
|---|---|
| ***E21B 34/08*** | (2006.01) |
| ***E21B 19/00*** | (2006.01) |
| ***E21B 21/10*** | (2006.01) |

(52) U.S. Cl.

CPC ..... *E21B 34/08* (2013.01); *E21B 19/00* (2013.01); *E21B 21/10* (2013.01)

(58) Field of Classification Search

CPC ..... E21B 19/02; E21B 19/00; E21B 19/16; E21B 21/10; E21B 33/03

USPC ..... 166/85.1

See application file for complete search history.

(56) References Cited

U.S. PATENT DOCUMENTS

| | | | |
|---|---|---|---|
| 1,635,749 | A | 7/1927 | Hosmer |
| 1,754,692 | A | 4/1930 | Miller |
| 2,139,983 | A | 12/1938 | Stone |

(Continued)

OTHER PUBLICATIONS

ABS; Mobile Offshore Drilling Units—Classification, Certification & Related Services; at least as early as Apr. 2014; ABS, Houston, TX; US.

(Continued)

*Primary Examiner* — Robert E Fuller
*Assistant Examiner* — Steven MacDonald
(74) *Attorney, Agent, or Firm* — Jeffery L. Wendt; The Wendt Firm, P.C.

(57) ABSTRACT

Inside blowout preventer release tool body having a one-piece planar upper section and a one-piece tubular lower section. In one embodiment, the upper section includes a pair of longitudinal members defining a central open region, the longitudinal members joined at one end having a formed lifting feature configured to accept a manipulator cable or chain. The lifting feature is positioned such that when the release tool body and an inside blowout preventer connected thereto are lifted by the rig hoist using cables, chains, and the like, they are easily moved over, aligned with, and connected with a working drillpipe while minimizing possibility of slipping off the cables or chains. The lower section includes a threaded end mating with a mating end of an inside blowout preventer, a central longitudinal bore to accept a release rod, and an upper end formed to accept the lower ends of the longitudinal members of the upper section. In one embodiment, elongate slots in each longitudinal member define one or more manipulating handles for a rig worker, machine, or tool. In other embodiments a pair of generally horizontal hand holds are defined in each longitudinal member.

23 Claims, 10 Drawing Sheets

(56) References Cited

U.S. PATENT DOCUMENTS

| | | | | |
|---|---|---|---|---|
| 2,213,309 | A * | 9/1940 | Fortune | E21B 21/106 137/322 |
| 2,624,610 | A | 1/1953 | Murphy | |
| 2,647,728 | A | 8/1953 | Smith | |
| 2,752,119 | A | 6/1956 | Allen et al. | |
| 3,066,590 | A | 9/1957 | Böhm | |
| 2,894,715 | A | 7/1959 | Bostock | |
| 3,035,808 | A | 5/1962 | Knox | |
| RE25,471 | E | 11/1963 | Fredd | |
| 3,126,908 | A | 3/1964 | Dickens | |
| 3,667,505 | A | 6/1972 | Radig | |
| 3,667,557 | A | 6/1972 | Todd et al. | |
| 3,783,942 | A | 1/1974 | Mott | |
| 3,835,925 | A | 9/1974 | Mott | |
| 3,850,191 | A | 11/1974 | Brown | |
| 3,850,194 | A | 11/1974 | Brown | |
| 3,861,470 | A | 1/1975 | Mott | |
| 3,941,348 | A | 3/1976 | Mott | |
| 4,040,441 | A | 8/1977 | Brown et al. | |
| 4,049,015 | A | 9/1977 | Brown et al. | |
| 4,074,761 | A | 2/1978 | Mott | |
| 4,088,298 | A | 5/1978 | Brown et al. | |
| 4,108,203 | A | 8/1978 | Brown | |
| 4,125,164 | A | 11/1978 | Terry | |
| 4,263,936 | A | 4/1981 | Brown | |
| 4,291,762 | A | 9/1981 | Gudgel | |
| 4,294,314 | A | 10/1981 | Miyagishima et al. | |
| 4,403,628 | A * | 9/1983 | Nijjar | E21B 21/10 137/515.5 |
| 4,417,600 | A | 11/1983 | Kohn | |
| 4,467,823 | A | 8/1984 | Shaffer et al. | |
| 4,478,279 | A | 10/1984 | Puntar et al. | |
| 4,480,813 | A | 11/1984 | Holley | |
| 4,523,608 | A | 6/1985 | Miller | |
| 4,650,153 | A | 3/1987 | Winegeart | |
| 4,681,133 | A | 7/1987 | Weston | |
| 4,694,855 | A | 9/1987 | Cunningham | |
| 4,795,128 | A | 1/1989 | Krasnov et al. | |
| 5,246,203 | A | 9/1993 | McKnight et al. | |
| 5,507,467 | A | 4/1996 | Mott | |
| 5,529,285 | A | 6/1996 | McKnight et al. | |
| 6,158,505 | A | 12/2000 | Araujo | |
| 6,712,147 | B2 | 3/2004 | Dallas | |
| 7,108,081 | B2 | 9/2006 | Boyadjieff | |
| 7,137,453 | B2 | 11/2006 | Gustafson et al. | |
| 7,308,954 | B2 | 12/2007 | Martin-Marshall | |
| 7,950,668 | B2 | 5/2011 | Gustafson et al. | |
| 8,230,931 | B2 | 7/2012 | Rodriguez et al. | |
| 8,443,876 | B1 | 5/2013 | Keast | |
| 8,443,877 | B1 | 5/2013 | Keast | |
| 2013/0043044 | A1 | 2/2013 | Garber et al. | |
| 2015/0068768 | A1 | 3/2015 | Williams | |

OTHER PUBLICATIONS

ASME; Development of Fatigue Resistant Heavy Wall Riser Connectors for Deepwater HPHT Dry Tree Riser systems; Proceedings of the ASM 28th International conference on Ocean, Offshore and Arctic Engineering; May 31-Jun. 5, 2009; ASME, Honolulu, HI.

M & M Internatonal; Ball Valves Product Information Sheet; at least as early as Apr. 2014; M & M International; Broussard, LA; US.

McMaster-Carr; Quick-Release One-Piece Clamp-on Shaft Collar product information sheet; Sep. 10, 2013; McMaster-Carr, Atlanta, GA; US.

McMaster-Carr; Steel Round Knurled-Rim Knob product information sheet; Sep. 10, 2013; McMaster-Carr, Atlanta, GA; US.

Moffat 2000 Limited; Moffat Subsea Stab Connector™; no month, 2010; Moffat (2000) Ltd; Northumberland, UK.

TIW Corporation; Pressure Control Systems; Safety & Kelly Valve Systems; at least as early as Apr. 2014; TIW Corporation; A Pearce Industries Company; Houston, TX; US.

WNCO Valve International; Inside B.O.P. Dart Valves; no month, 2013; WNCO Valve International, Odessa, TX; US.

* cited by examiner

RELEASE TOOL FOR A DRILL STRING INSIDE BLOWOUT PREVENTER

BACKGROUND INFORMATION

1. Technical Field

The present disclosure relates to apparatus and methods in the onshore and marine (offshore) hydrocarbon exploration, production, drilling, well completion, well intervention, and leak containment fields. More particularly, the present disclosure relates to release tools for inside blowout preventers.

2. Background Art

A "blowout (or blow out) preventer", commonly known as a "BOP", is a valve that may be used to prevent a well, usually a hydrocarbon producing well, from flowing uncontrollably. An "inside BOP" (also sometimes referred to as an "internal BOP", "IBOP", "kelly valve", or "kelly cock") is a BOP inside a drillpipe or drillstring, usually used to prevent the well from flowing uncontrollably up the drillstring. Industry standards require having an IBOP for every string of pipe in the hole on every rig that is working.

Currently, IBOPs, which may weight 300 pounds or more, have no lifting eyes on their cap (also referred to as a "release tool") or otherwise, although separate lifting devices that attach to the drillpipe and/or IBOP may have one or more lifting eyes, as taught in U.S. Pat. No. 4,291,762. They have been this way for many years. FIG. 1 is a side elevation view, partially in cross-section, of a non-limiting representative example of such an IBOP. There are many types of IBOP, and the present disclosure is relevant to all. U.S. Pat. Nos. 2,647,728; 4,403,628; 4694855; 4294314; 4478279; 5,507,467; 8,443,876; 8,443,877; 3,667,557; 3,835,925; 3,861,470; 4,291,762; 7,137,453; 7,950,668, and 7,108,081; and U.S. Published patent application no. 2013/0043044A1 all describe various types of IBOPs and/or accessories for same, such as actuators for IBOPs. Other examples of IBOPs may presently be found on the Internet websites of Global Manufacturing and M&M Industries. All of these patents and published patent applications are incorporated herein by reference.

In current practice in the field, the drilling rig workers tie a chain, cable, or strap around the IBOP valve cap to pick up the cap and the IBOP valve to which it is attached using a rig hoist and stab it into the drillpipe. The valve must be open (as shown in FIG. 1) in order to screw it into the drill pipe. If closed the pressure will blow it out before the threads can be started. The drilling rig workers turn the valve clockwise by hand to screw it into the drillpipe. In some instances, rig workers grab side handles (round rods welded to the release tool, as depicted in FIG. 1) and turn it with the round rods. Then they loosen the lock screw to release the rod holding the valve open. Then they tighten the threads with the rig tongs and the well is secure. Mud or other drilling fluid may then be pumped through the valve down hole but no pressurized fluids may come out of the drillpipe. One of the above patents, U.S. Pat. No. 4,403,628, implies in Col. 3 of the patent that assembling an IBOP into a drill stem and removing the IBOP therefrom as just described, including lifting and manipulating the IBOP, is conveniently performed, but this is contrary to experience, as accidents can and have occurred. Rig personnel safety is of utmost concern. The inventor herein personally knows of several accidents where the old style cap/release tool and IBOP valve slipped off the chain, cable, or strap, dropping the IBOP. While the "iron" (slang term for rig tools) is used to being dropped and banged around the rig, the rig workers have the difficult tasks of not only using the rig hoist to pick up the IBOP/release tool, using chains or otherwise, but picking it up straight (vertical or substantially vertical) to align with and screw onto the working drillpipe, which more often than not has fluids and possibly solids escaping out at a high rate. Experience shows that when rig workers are required to make a loop with a chain, cable, rope, or strap around the whole valve (for example around two handles 21) it rarely if ever picks up straight; it is then necessary to attempt to get it straight to get threads 20 on the lower end started in the drillpipe threads. In the meantime, the valve or other rig components may shift position and the valve slips off the chain, with potential to injure rig workers, and without stopping flow from the drillpipe. Complications only increase on offshore rigs, whether working subsea or "dry" at the surface on the rig.

As may be seen, current practice of installing and removing IBOPs may not be adequate for all circumstances. There remains a need for more robust IBOP release tool designs, particularly for apparatus and methods allowing safe and quick connection/disconnection and ease of alignment, without extra tools, lifting frames, or effort. The apparatus and methods of the present disclosure are directed to these needs.

SUMMARY

In accordance with the present disclosure, improved release tools for IBOPs and methods of assembling the release tools and IBOPs and using same are described which reduce or overcome many of the faults of previously known tools and methods.

A first aspect of the disclosure is a modular release tool body for use with inside blowout preventers comprising:

- a one-piece, formed (defined herein as including milled, machined, molded, cast, machined or milled billet, but not welded or brazed), planar metallic upper section having a longitudinal axis, the upper section comprising a pair of longitudinal members defining a central open region, each longitudinal member having a lower end, the longitudinal members joined by a top manipulating end having one or more lifting features formed therein configured to accept one or more manipulators (cables, chains, straps, ropes), the one or more formed lifting features positioned such that when the release tool body and an inside blowout preventer connected thereto are lifted by the one or more manipulators, they are easily moved over, aligned with, and connected with a working drillpipe while minimizing possibility of slipping off the cables or chains; and
- a one-piece, formed, tubular metallic lower section removably attached to the upper section having the same longitudinal axis as the upper section, the lower section comprising a threaded (preferably externally tapered pin) end configured to threadedly mate with an end (preferably a box end) of an inside blowout preventer;
  - a central longitudinal bore configured to slidingly accept a release rod;
  - an upper end formed to accept the lower ends of the longitudinal members of the upper section and retaining members therefore;
  - the upper end further formed to comprise a central axial extension comprising one or more fluid outlets fluidly connected with the central longitudinal bore, the central axial extension of length sufficient to accommodate an internally threaded bore substantially perpendicular to and intersecting the central longitudinal bore, and configured to accept a mating threaded release rod lock screw therein.

In certain embodiments, the one or more lifting features may be a single centered lifting eye formed through the top (manipulating) end of the upper section. Certain embodiments may comprise one or more formed, elongate slots in each longitudinal member of size sufficient to define one or more manipulating handles for a rig worker or mechanical manipulator to grasp the upper section and rotate the release tool and thread the pin end of the lower section into the box end of the inside blowout preventer. In certain embodiments the upper end of the lower section may be formed to include a pair of vertical receptacles for the lower ends of the upper section, wherein the retaining members may comprise one or more screws, bolts, pins, and the like threaded (or otherwise positioned and secured) through corresponding threaded (or other) bores through the receptacles and lower ends. In certain embodiments the central open region is sufficiently large to allow a rig worker or mechanical manipulator to engage a release rod and move the release rod downward, opening a valve in the inside blowout preventer.

Another aspect of the disclosure is a modular release tool for use with inside blowout preventers comprising:

the release tool body;

a release rod slidingly positioned in the lower section central bore and dimensioned so as to be accessible by a rig worker or remotely operated device through the central region of the upper section, the central region having a width substantially larger than diameter of the release rod; and one or more formed, elongate slots in each longitudinal member of size sufficient to define one or more manipulating handles for a rig worker or mechanical manipulator to grasp the upper section and rotate the release tool and thread the pin end of the lower section into the box end of an inside blowout preventer.

Another aspect of the disclosure is a combination modular release tool and inside blowout preventer for threadedly attaching to a drillpipe, the drillpipe having a threaded end (preferably an enlarged external diameter internally threaded upset end) for engaging the inside blowout preventer, the combination comprising an inside blowout preventer having a lower end threadably engageable with the drillpipe threaded end and an upper box end threadably engaged with a modular release tool of the present disclosure.

In addition to the features already mentioned, modular release tools and combinations of release tool/IBOP may further comprising a combination of metallurgy and structural reinforcement such as to prevent failure of the inside blowout preventer and/or release tool upon exposure to inner pressure up to 10,000 psia, or up to 15,000 psia, or up to 20,000 psia, or up to 25,000 psia, or up to 30,000 psia or higher, such as may be experience during onshore or offshore subsea drilling operations. Especially for offshore subsea applications, certain embodiments may further comprise one or more of the following features: one or more subsea hot stab ports for subsea ROV (remotely operated vehicle) intervention and/or maintenance of the inside blowout preventer and/or release tool; one or more ports allowing pressure and/or temperature monitoring inside the inside blowout preventer and/or release tool; one or more subsea umbilicals fluidly connected to one or more locations on the IBOP selected from the group consisting of a kill line, a choke line, and both kill and choke lines, optionally wherein one of the umbilicals is fluidly connected to a subsea manifold.

Another aspect of the disclosure is a method of easily and safely attaching a combination inside blowout preventer and modular release tool having a lower threaded end to a threaded end of a working drillpipe, the method comprising the steps of:

(a) assembling the combination;

(b) pressing down on a top end of the release rod, moving the release rod down into a position holding a valve of the inside blowout preventer open;

(c) locking the valve open by tightening the release rod lock screw;

(d) lifting the combination of step (c) to a position over the drillpipe threaded end using the one or more formed lifting features on the release tool;

(e) threading the combination of step (c) onto the drillpipe and continue turning the combination of step (c) so that the threads of the lower end of the inside blowout preventer thread into the threads of the drillpipe; and (f) loosening the release rod lock screw, allowing closing of the valve and stopping flow of fluid through the inside blowout preventer.

An important feature of the apparatus and methods disclosed herein is the modularity, that is, the lower and upper sections of the release tool body may quickly and easily be disassembled, and the same upper section joined and used with another lower section of same or different outside diameter, such as if a one section cracks or otherwise becomes unusable. In certain embodiments the lower section may be changed to accommodate a different diameter working drillpipe, although that may rarely occur. In certain embodiments, the method comprises changing the lower section of the release tool body to match size (outside diameter) of another inside blowout preventer prior to attaching the release tool to the other inside blowout preventer.

These and other features of the apparatus and methods of the disclosure will become more apparent upon review of the brief description of the drawings, the detailed description, and the claims that follow.

BRIEF DESCRIPTION OF THE DRAWINGS

The manner in which the objectives of this disclosure and other desirable characteristics can be obtained is explained in the following description and attached drawings in which:

FIGS. 3A and 3B illustrate schematic side elevation and plan views, respectively, of the lower section of the release tool body embodiment illustrated in FIG. 2, while

It is to be noted, however, that the appended drawings of FIGS. 1-6 and 8-10 may not be to scale, and illustrate only typical apparatus embodiments of this disclosure. Furthermore, FIG. 7 illustrates only one of many possible methods of this disclosure. Therefore, the drawing figures are not to be considered limiting in scope, for the disclosure may admit to other equally effective embodiments.

DETAILED DESCRIPTION

Figure 1:
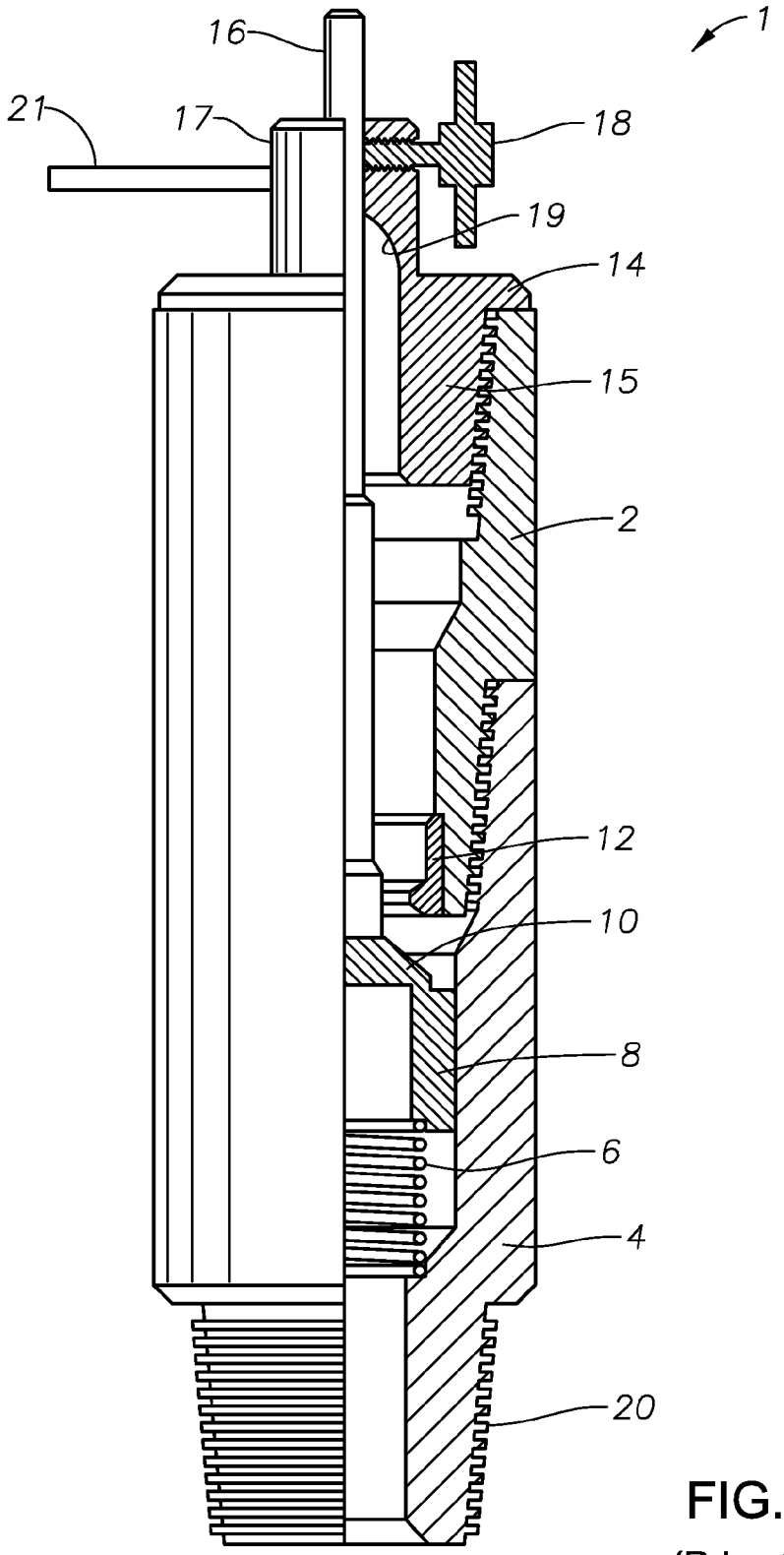
FIG. 1 (Prior Art)
FIG. 1 is a schematic side elevation view, partly in cross-section, of a prior art combination inside blowout preventer and release tool.

In the following description, numerous details are set forth to provide an understanding of the disclosed apparatus, combinations, and methods. However, it will be understood by those skilled in the art that the apparatus, combinations, and methods disclosed herein may be practiced without these details and that numerous variations or modifications from the described embodiments may be possible. All U.S. published patent applications and U.S. Patents referenced herein are hereby explicitly incorporated herein by reference, irrespective of the page, paragraph, or section in which they are referenced.

The primary features of the apparatus, combinations, and methods of the present disclosure will now be described with reference to the drawing figures, after which some of the construction and operational details, some of which are optional, will be further explained. The same reference numerals are used throughout to denote the same items in the figures.

One aspect the present disclosure is a replacement for a release tool 14 (FIG. 1) that is already on at least 1000 drilling rigs in operation today. The primary focus was to replace the old release tools 14 with a new design (one embodiment 100 of which is illustrated in schematic perspective view in FIG. 2) so rig workers or rig tools operated by rig workers could place chain or other lifting attachment through a lifting eye, and also provide hand slots to "make it up" (slang term for attaching two oilfield components, here the new release tool to an IBOP).

Prior to explaining features of the new release tool and other inventive aspects, reference should be made to FIG. 1, which is a schematic side elevation view, partly in cross-section, of a prior art combination 1 of an inside blowout preventer and release tool 14 known under the trade designation "WN-2 Inside BOP Dart Valve", available from WNCO Valve International, Odessa, Tex. (USA). The inside blowout preventer ("IBOP") includes an upper sub 2 and a lower sub 4 joined using tapered threads as illustrated. One-piece IBOP bodies are also known, and the release tools of the present disclosure are applicable to either variety of IBOP body. The IBOP may include a spring 6 biased to push up a dart 8 into mating relationship with a dart "O" ring 10 and dart seat 12. Other types of IBOP may feature a check valve (flap valve), and the release tools of the present disclosure are suitable for use with any type of IBOP. Lower sub 4 includes a lower threaded end 20 (either pin or box, usually a pin end as illustrated) to threadably mate with a working drillpipe (either box or pin end, usually a box end). The drillpipe is not illustrated.

Still referring to FIG. 1, prior art release tool 14 includes a lower body 15 that mates with upper sub 2. Usually, lower body 15 includes external tapered threads and upper sub 2 includes mating internal tapered threads, as illustrated, but other arrangements are possible. Prior art release tool 14 further includes a release rod 16 that extends through a bore of an axial extension 17, and a rod lock screw 18, the operation of which are very familiar to those of ordinary skill and require no further explanation. Some axial extensions include an open or closed archway such as 19, and some suppliers may provide one or more lateral "grab handles" 21 welded to the axial extension if asked for by rig workers or rig owners (or rig workers/owners may weld them on after purchasing them).

Using prior art release tools such as 14, rig workers would attempt to lift and move the combination IBOP/release tool into position over a working drillpipe for attachment using a rig hoist. The problem is that the open archway 19, if present, and/or lateral grab handles 21, are not lifting eyes. They are hard to tie onto. Rig workers formerly would wrap a manipulator (chain, cable, strap, or rope) around the grab handles 21 and pick up the device using the rig hoist, align threads 20 with threads of the working drillpipe, and turn (rotate) the IBOP/release tool using grab handles 21, with or without a chain tongs. The IBOP may weigh from 200 to 300 pounds (91 to 136 kg). Injury to rig workers is of utmost concern. While the "iron" (oilfield term for rig tools) is accustomed to being dropped and banged around the rig, the rig workers have the difficult tasks of not only picking up the IBOP/release tool using the rig hoist, but picking it up straight (vertical or substantially vertical) to align with and screw onto the working drillpipe, which more often than not has fluids and possibly solids escaping out at a high rate. Experience shows that when rig workers are required to make a loop with a chain, cable, strap, or rope around the whole valve (for example around two handles 21) it rarely if ever picks up straight; it is then necessary to attempt to get it straight to get threads 20 started in the drillpipe threads. In the meantime, the valve or other rig components shift position and the valve slips off the chain, with potential to injury rig workers, and without stopping flow from the drillpipe.

Figure 2:
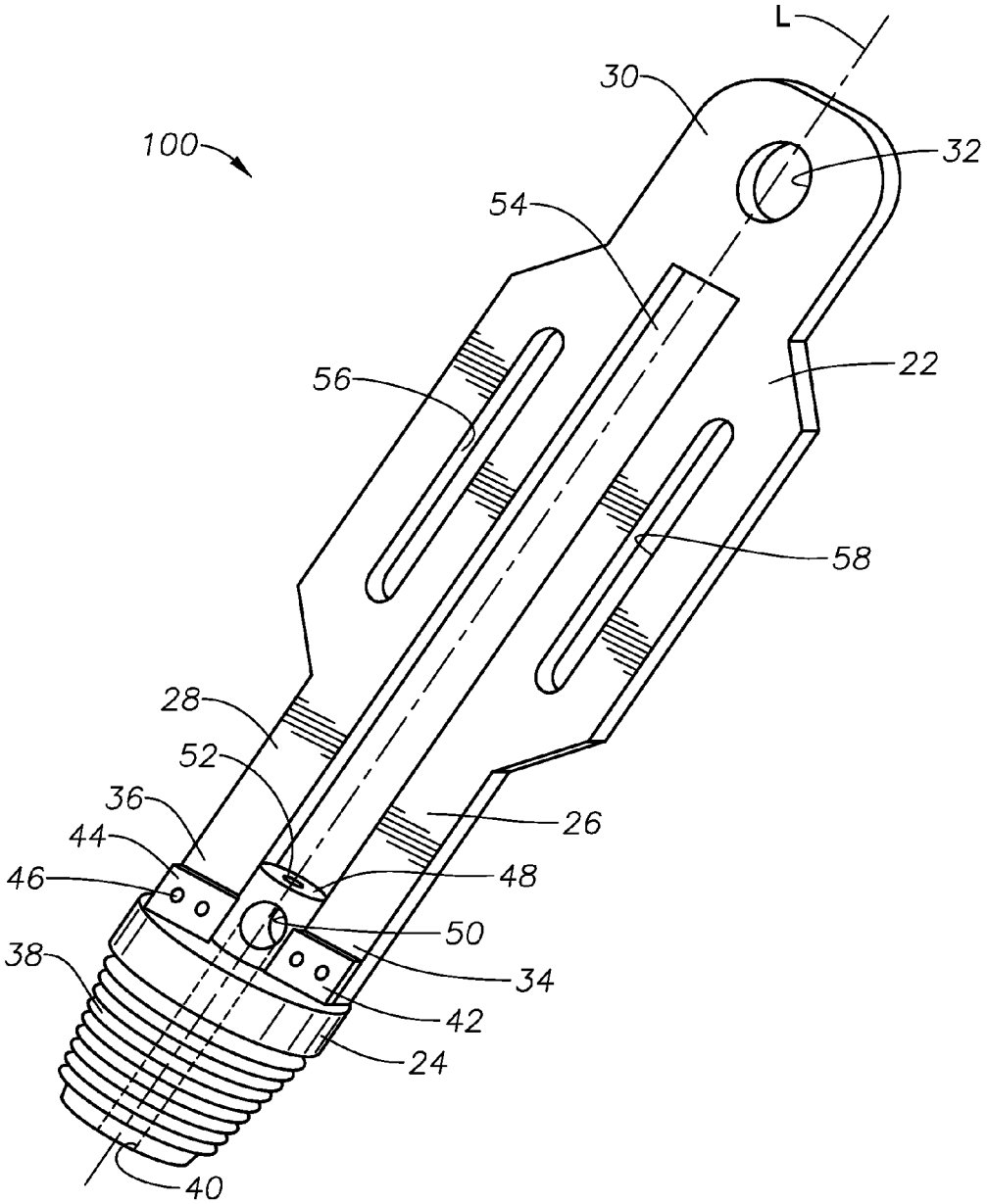
FIG. 2 is a schematic perspective view of one release tool body embodiment within the present disclosure.

With these problems in mind, the release tools of the present disclosure were developed. FIG. 2 is a schematic perspective view of one release tool body embodiment 100 within the present disclosure. Release tool body 100 includes an upper "flat iron" section 22 having a longitudinal axis "L", and a lower tubular section 24 of same longitudinal axis. Upper section 22 is comprised of two longitudinal members 26, 28, joined by a top manipulating end 30. Upper section 22 is a one-piece, formed, planar, metallic component with no welds, brazing or components welded or brazed thereto. This eliminates the need for pull testing (tensile testing) in offshore applications. Longitudinal members 26, 28 define a central open region 54 there between, each longitudinal member having a lower end 34, 36, respectively. Top manipulating end 30 includes one or more lifting features 32 formed therein configured to accept one or more manipulator cables or chains (not illustrated), the one or more formed lifting features 32 (lifting eye in FIG. 2) positioned such that when the release tool body 100 and an inside blowout preventer connected thereto (such as depicted schematically in FIG. 4) are lifted by the rig hoist using cables, chains, and like manipulators, they are easily moved over, aligned with, and connected with a working drillpipe while minimizing possibility of slipping off the cables or chains. Severe injury to rig workers is thereby avoided, or at least the possibility greatly reduced, compared with previous designs.

Figure 4:
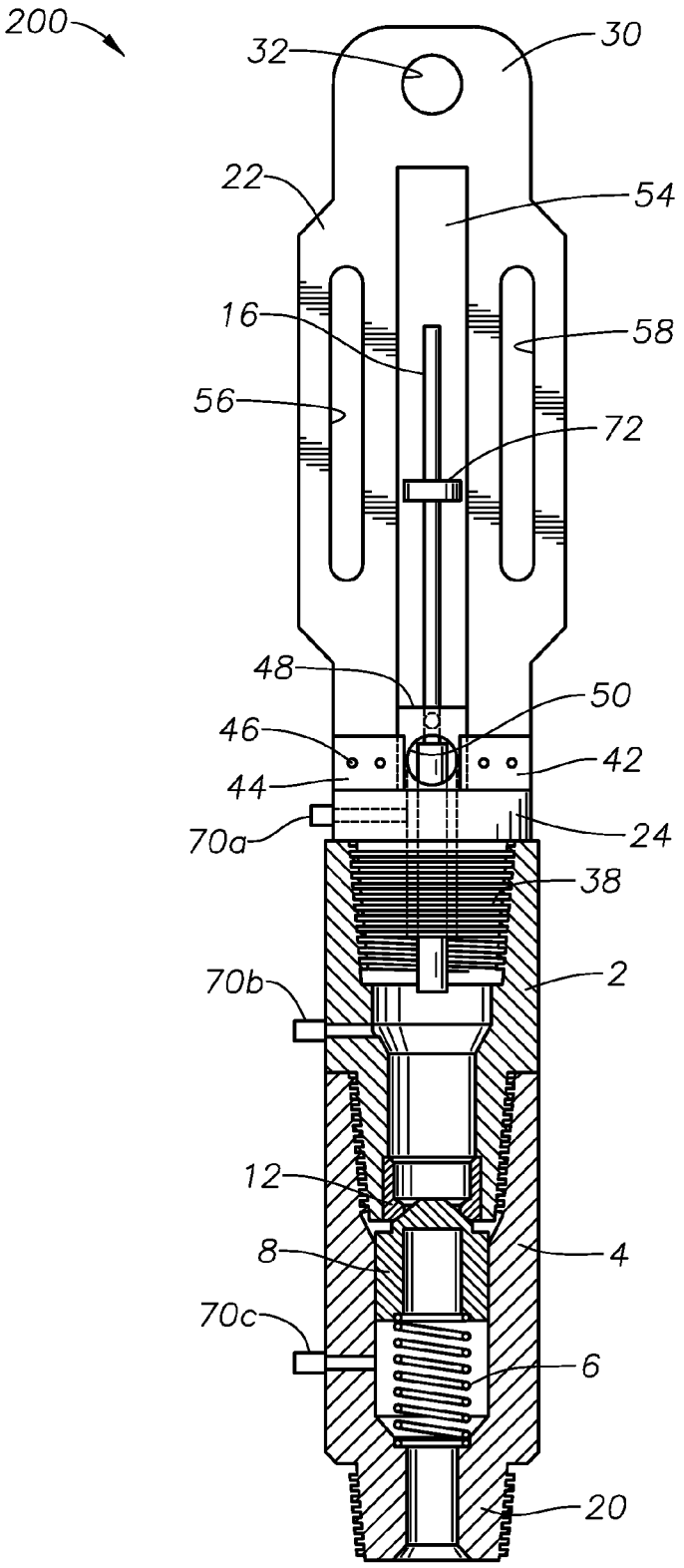
FIG. 4 is a schematic side elevation view, partly in cross-section, of a combination inside blowout preventer and release tool within the present disclosure.

Still referring to FIG. 2, upper section 22 includes, in embodiment 100, a pair of elongate formed slots 56, 58, one each in this embodiment formed into and through longitudinal members 28, 26, respectively. Elongate formed slots 56, 58 serve as handles for turning release tool 100 and IBOP attached thereto, (as illustrated in FIG. 4) when positioned and aligned with a working drillpipe. It will be appreciated that more than one slot (or other shaped) through-holes, may be provided in each longitudinal member 26, 28. It is not necessary that slots 56, 58, be the same length or shape; however, in order to provide the best weight balance, and therefore best ease of positioning and making up to the drillpipe, it is preferred that longitudinal member 26 be a substantial mirror image of longitudinal member 28, with slots of substantially equal length and shape.

Again referring to FIG. 2, lower section 24 includes a threaded end 38, illustrated in FIG. 2 as a pin end, having a central bore 40 illustrated in phantom. Central bore 40 continues up through a lower portion of an axial extension 48, with central bore 40 having a diameter substantially equal to a generally perpendicular fluid outlet port 50 in axial extension 48. Central bore 40 and outlet port 50 fluidly cooperate to direct flow of fluids and other matter out of release tool 100 while it and the IBOP to which it is attached are being secured to the working drillpipe. Outlet port 50 may be a bore substantially perpendicular to longitudinal axis L, but that is not strictly required. More than one outlet port may be provided as well. Axial extension 48 also includes a central bore 52 having a diameter slightly larger than a release rod (not illustrated in FIG. 2), the release rod being in sliding engagement with central bore 52. Lower section 24 further includes a pair of formed receptacles 42, 44, perhaps more clearly illustrated in FIGS. 3A and 3B and discussed further herein below. Formed receptacles 42, 44 serve to accept and retain lower ends 34, 36 of longitudinal members 26, 28, in conjunction with retaining screws, bolts, pins or other components (not shown) inserted through passages 46 (two passages 46 for retaining screws, bolts or pins are illustrated for each receptacle 42, 44).

Figure 3B:
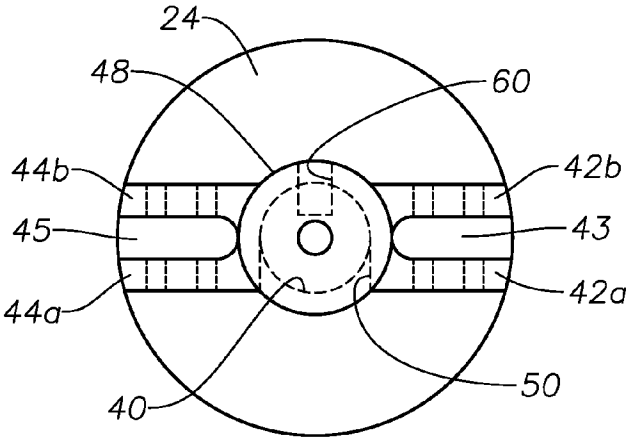
Figure 3C:
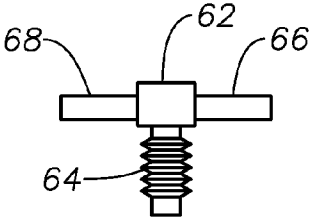
FIG. 3C is a side elevation view of a release rod lock screw useful therewith.
Figure 3A:
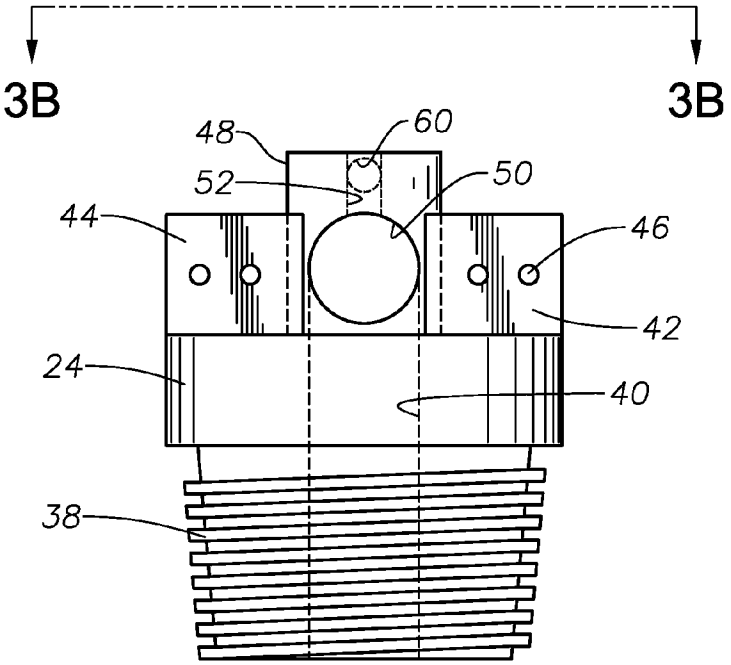

Referring now specifically to FIGS. 3A and 3B, FIG. 3A illustrates a schematic side elevation view, and FIG. 3B a plan view, respectively, of lower section 24 of the release tool body embodiment 100 illustrated in FIG. 2. (FIG. 3C is a side elevation view of a release rod lock screw 62 useful therewith; as this component is well-known it is not further discussed in detail, except to note that a threaded through hole 60 is provided in axial extension 48 to accommodate threads 64 of rod lock screw 62, which is turned using handles 66, 68.) As illustrated in the plan view of FIG. 3B, receptacles 42 and 44 may each be formed into lower section 24 to form a pair of slots 43, 45 (slot 43 formed between sub-receptacles 42*a*, 42*b*, and slot 45 formed between sub-receptacles 44*a*, 44*b*, as illustrated). Slots 43, 45 accept ends 34, 36 of longitudinal members 26, 28, as previously explained. It should be noted that in alternative embodiments considered within the present disclosure, ends 34, 36 could be formed to form a female connection to fit onto male members 42, 44, respectively. Since torque is effected on upper section 22 when making up to a working drillpipe, the embodiment illustrated in FIGS. 2 and 3 may be preferred as being somewhat stronger. Slots 43, 45 are formed out of the bottom section so that no welding, brazing, or other heat-formed attachment is involved.

In practice, upper section 22 with lifting eye 32 is interchangeable with all lower sections 24 so that a relatively small batch of upper sections 22 could be made and distributed, whereby a user (rig owner and rig workers) could fit a single upper section 22 on multiple lower sections 24 to fit corresponding sizes of IBOP, in turn corresponding to a variety of sizes of working drill pipe as a well is drill or otherwise worked. While not strictly necessary, the hand holds formed by longitudinal members 26, 28 and slots 56, 58 are preferably flat (planar). For subsea use they maybe painted or otherwise colored or made reflective for ease of recognition. Structurally, the new release tool bodies of the present disclosure may support a weight of 3000 pounds (1360 kg) or more when made of 4140HT steel, or equivalent material.

FIG. 4 is a schematic side elevation view, partly in cross-section, of a combination inside blowout preventer and release tool 200 within the present disclosure. Quickly aligning and threadably attaching an IBOP to a working drillpipe in the event of a blowout or impending blowout is recognized in the art. What has not been recognized or realized is an apparatus and method to accomplish this without significant risk of the apparatus slipping off lifting devices. As explained previously, external frames have been designed, some with lifting eyes, for effecting alignment, but these add cost and complexity to the procedure, or if available are not necessarily used or favored by rig personnel. Or the prior art simply states that alignment and connection is conveniently done without such external frames, using welded-on handles. The present inventor, however, knows such is not always the case, and knows of multiple accidents that have injured rig workers.

Lower section 24 is illustrated as threaded into upper sub 2 of a prior art IBOP, such as previously disclosed in relation to FIG. 1, or some other prior art IBOP. One or more subs 70*a*, 70*b*, and/or 70*c* may optionally be supplied, especially for subsea use. For example, one or more subs 70*a*, 70*b*, 70*c* may connect to a hydrate inhibition chemical supply line, and when circulating the chemical, it may return to a surface vessel through a return line via a second sub. One or more subs 70*a*, 70*b*, 70*c* may connect a surface chemical supply to subsea choke and kill valves via choke and/or kill lines. One or more of subs 70*a*, 70*b*, 70*c* may be hot stab connections, such as API 17H standard hot stabs, or a pressure gauge, or facilities to allow other kill line parameters to be measured, for example, temperature, viscosity, and the like.

FIGS. 5A, 5B, 5C, and 5D are schematic perspective, side elevation (partially in phantom), reverse side elevation, and end views, respectively of an optional shaft collar 72 useful in certain embodiments. Referring again to FIG. 4, shaft collar 72 provides a "lock on" item to release rod 16 so users can tell if the valve of the IBOP is open or closed. A rig hand or other worker would press down on top of release rod 16, forcing dart 8 down and compressing spring 6, forcing open the valve, then turn release rod lock screw 62 (not shown in FIG. 4) to lock the valve open. A worker then will slide on a shaft collar 72 and move it all the way down next to top of central axial extension 48, clamping and locking shaft collar 72 closed using lever 73. Workers or other sensor may then visually see or otherwise detect that when shaft collar 72 rises or is at its upper-most position, the IBOP valve is closed. If shaft collar 72 is down all the way to central axial extension 48, the IBOP valve is open.

Figure 5A:
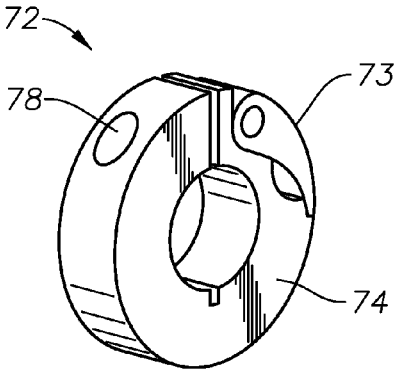
FIGS. 5A, 5B, 5C, and 5D are schematic perspective, side elevation (partially in phantom), reverse side elevation, and end views, respectively of an optional shaft collar useful in certain embodiments.
Figure 5B:
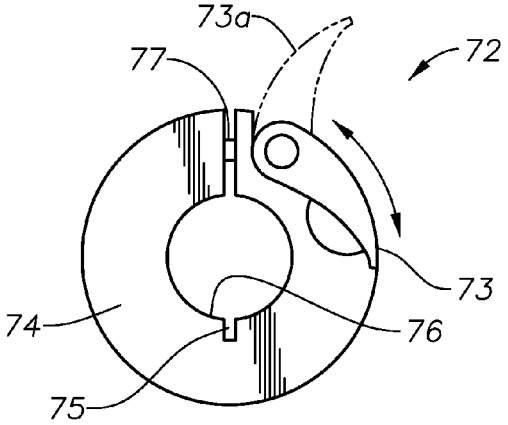
Figure 5C:
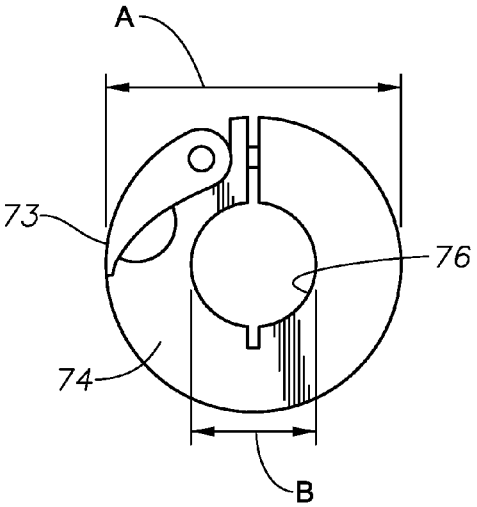
Figure 5D:
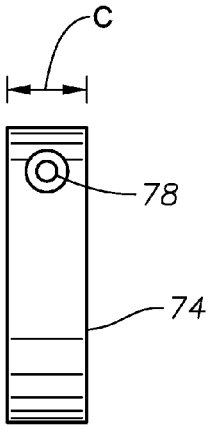

In certain embodiments, such as illustrated, shaft collar 72 may be a quick-release one-piece clamp-on shaft collar having a body 74 and a clamp lever 73 attached thereto by a pin or other attachment. Clamp lever 73*a* is illustrated in phantom in its open position in FIG. 5B, with double-headed arrow showing movement of clamp lever 73 to closed position. Body 74 may include one or more expansion slits or gaps 75. Body 74 includes an inner surface 76, preferably smooth so as not to mar release rod 16 when clamp lever 73 is closed. Shaft collar 72 further includes a set screw 77 for adjusting the clamping action. Set screw 77 may include a socket head 78, as illustrated in FIG. 5D. Dimensions A, B, and C may vary, and will largely be dictated by diameter of release rod 16. Dimension A may range from about 20 to about 60, or from about 30 to about 50 mm; dimension B may range from about 10 to about 30, or from about 10 to about 20 mm; and dimension C may range from about 5 to about 20, or from about 5 to about 10 mm. Quick-release one-piece clamp-on shaft collars with A=1.5 inch (about 38 mm), B=⅝ inch (about 16 mm), and C=0.4 inch (about 10 mm) are commercially available from McMaster-Carr Supply Company, Chicago, under trade designation 1511K13.

Figure 6A:
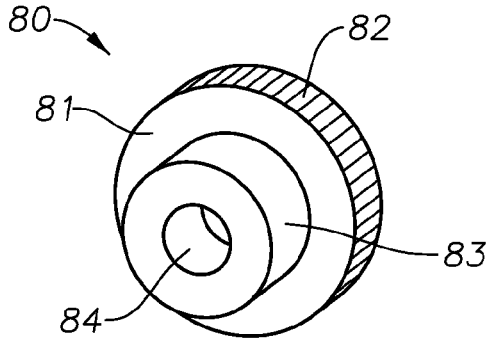
FIGS. 6A, 6B, and 6C are schematic perspective, end, and side elevation (partially in phantom) views, respectively, of an optional rod cap useful in certain embodiments.
Figure 6B:
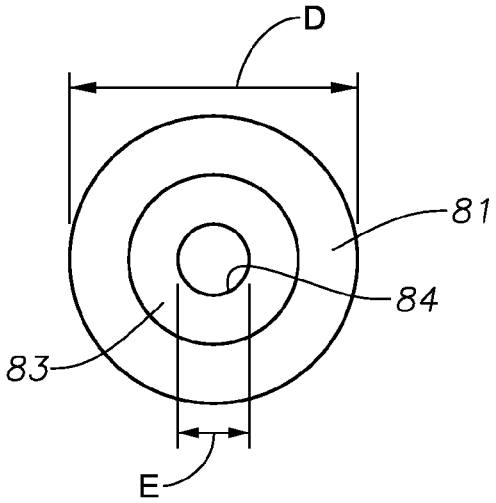
Figure 6C:
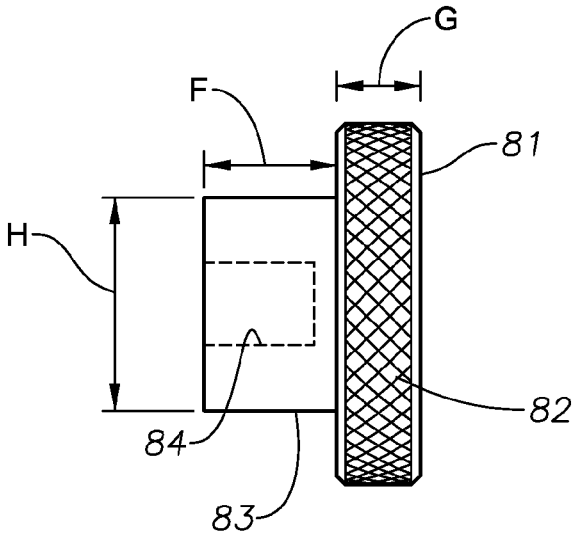

In certain embodiments, an optional rod cap 80 may be placed on the top of release rod 16 to make it easier to push down. FIGS. 6A, 6B, and 6C are schematic perspective, end, and side elevation (partially in phantom) views, respectively, of an optional rod cap 80 useful in certain embodiments. In embodiment 80, rod cap 80 includes a flange or lateral extension 81 having a knurled rim 82, and a hollow shaft 83 having a non-threaded inner surface 84. Dimensions D, E, F, G, and H may vary, and will largely be dictated by diameter of release rod 16. Dimension D may range from about 30 to about 90 mm, or from about 50 to about 70 mm; dimension E may range from about 10 to about 30 mm, or from about 10 to about 20 mm; dimension F may range from about 15 to about 30 mm, or from about 20 to about 30 mm; dimension G may range from about 5 to about 25 mm, or from about 10 to about 20 mm; and dimension H may range from about 20 to about 60 mm, or from about 30 to about 50 mm. Rod caps with D=2.5 inch (about 64 mm), E=⅝ inch (about 16 mm), F=15/16 inch (about 24 mm), G=9/16 inch (about 14 mm), and H=1.5 inches (about 38 mm) are commercially available from McMaster-Carr Supply Company, Chicago, under trade designation 6121K51.

Figure 7:
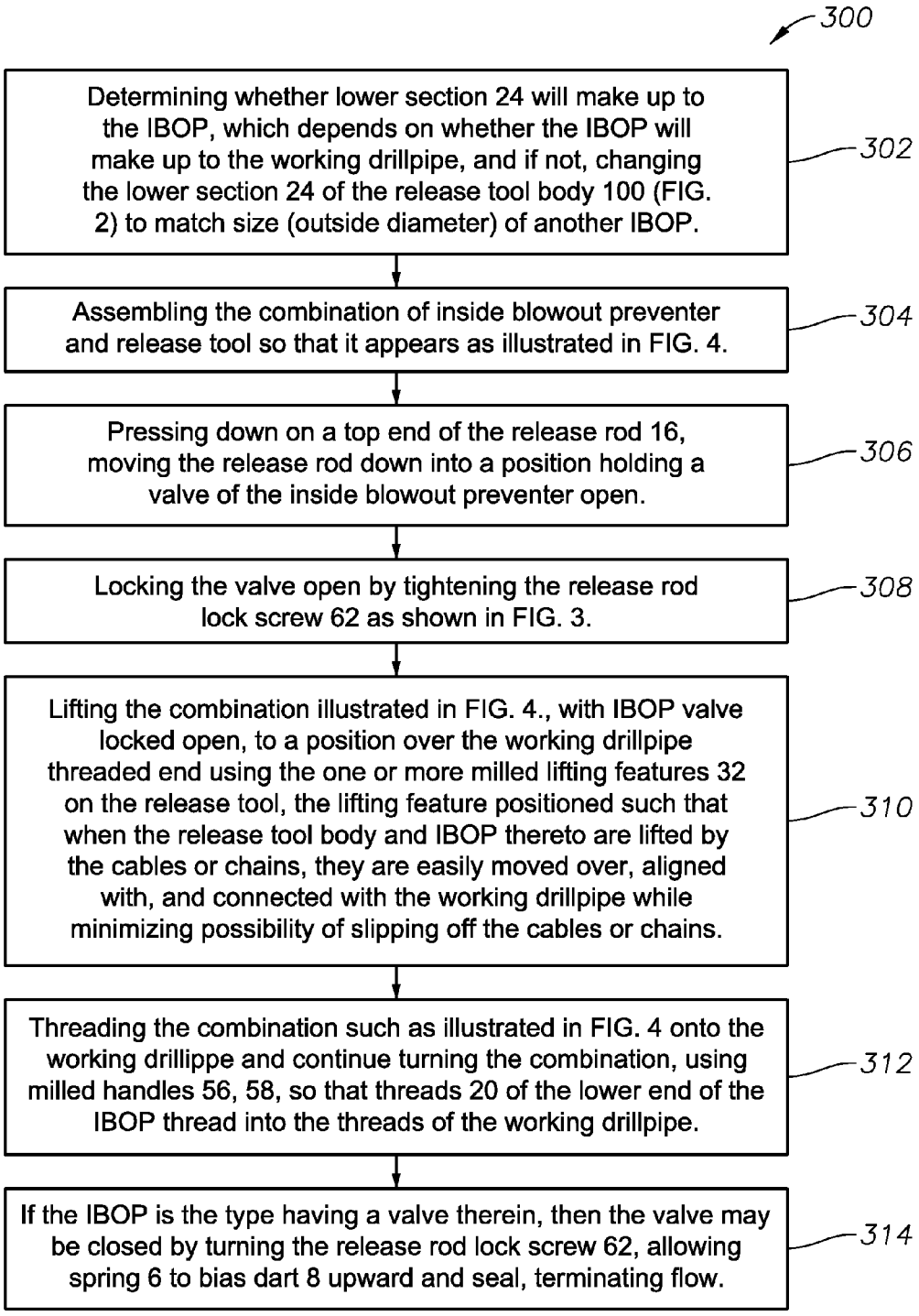
FIG. 7 is a logic diagram of a method of installing the combination of FIG. 4 onto a working drillpipe.

FIG. 7 is a logic diagram of easily and safely attaching a combination inside blowout preventer and release tool having a lower threaded end to a threaded end of a working drillpipe. In certain embodiments, the method first comprises determining whether lower section 24 will make up to the IBOP, which depends on whether the IBOP will make up to the working drillpipe, and if not, changing the lower section 24 of the release tool body 100 (FIG. 2) to match size (outside diameter) of another IBOP (box 302). The method further comprises assembling the combination of IBOP and release tool so that it appears as illustrated in FIG. 4 (box 304). The method further comprises pressing down on a top end of the release rod 16, moving the release rod down into a position holding a valve of the inside blowout preventer open (box 306). The method then comprises locking the valve open by tightening the release rod lock screw 62 as shown in FIG. 3 (box 308). The critical steps are then lifting the combination illustrated in FIG. 4, with IBOP valve locked open, to a position over the working drillpipe threaded end using the one or more formed lifting features 32 on the release tool, the lifting feature positioned such that when the release tool body and IBOP thereto are lifted by the cables or chains, they are easily moved over, aligned with, and connected with the working drillpipe while minimizing possibility of slipping off the cables or chains (box 310). The method continues with the step of threading the combination such as illustrated in FIG. 4 onto the working drillpipe and continue turning the combination, using formed handles 56, 58, so that threads 20 of the lower end of the IBOP thread into the threads of the working drillpipe (box 312). At this stage, if the IBOP is of the type having a check valve therein, as soon as the IBOP is fixed in position on the working drillpipe, no further escape of fluid or liquids will occur. If the IBOP is the type having a valve therein, then the valve may be closed by turning the release rock lock screw 62, allowing spring 6 to bias dart 8 upward and seal, terminating flow (box 314).

An important feature of the apparatus and methods disclosed herein is the modularity, that is, the lower and upper sections 22, 24 of the release tool body may quickly and easily be disassembled, and the same upper section 22 joined and used with another lower section 24 of same or different outside diameter, for example if the lower section is cracked or otherwise becomes unusable, or if there is a need to change to a different size drillpipe. In certain embodiments, the method comprises determining whether lower section 24 will make up to the IBOP, which depends on whether the IBOP will make up to the working drillpipe, and if not, changing the lower section 24 of the release tool body 100 (FIG. 2) to match size (outside diameter) of another IBOP.

Figure 8:
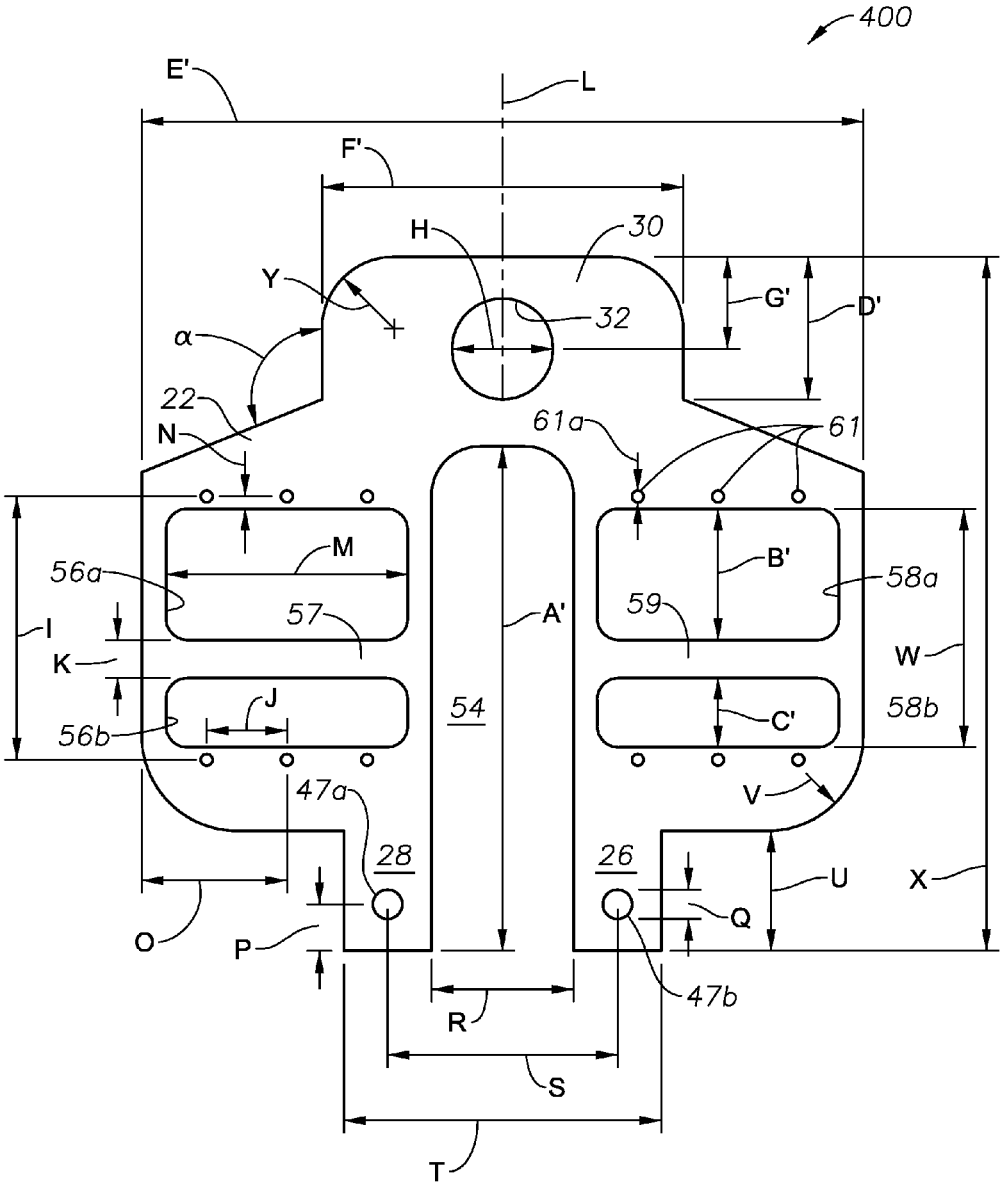
FIG. 8 is a side elevation view of another embodiment of the disclosure.
Figure 9:
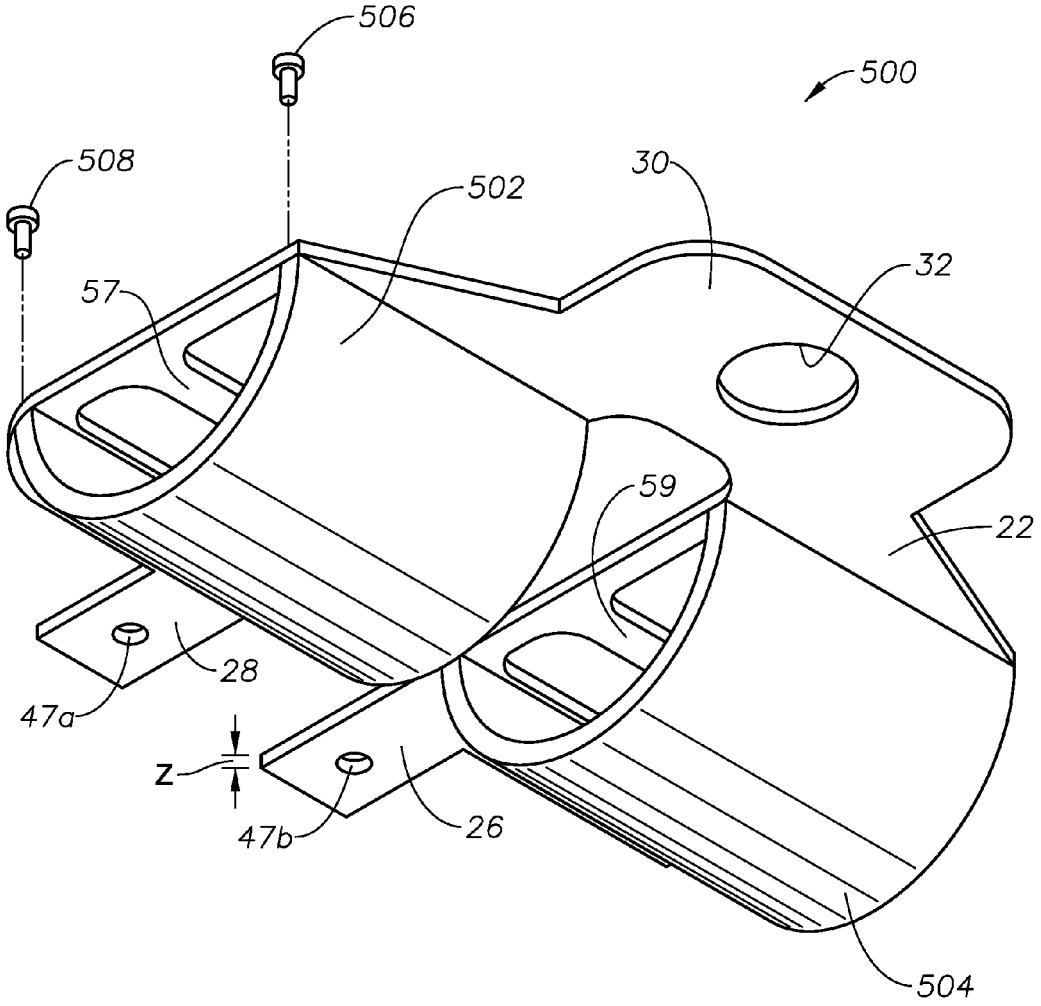
FIG. 9 is a perspective view of another embodiment of the disclosure.
Figure 10:
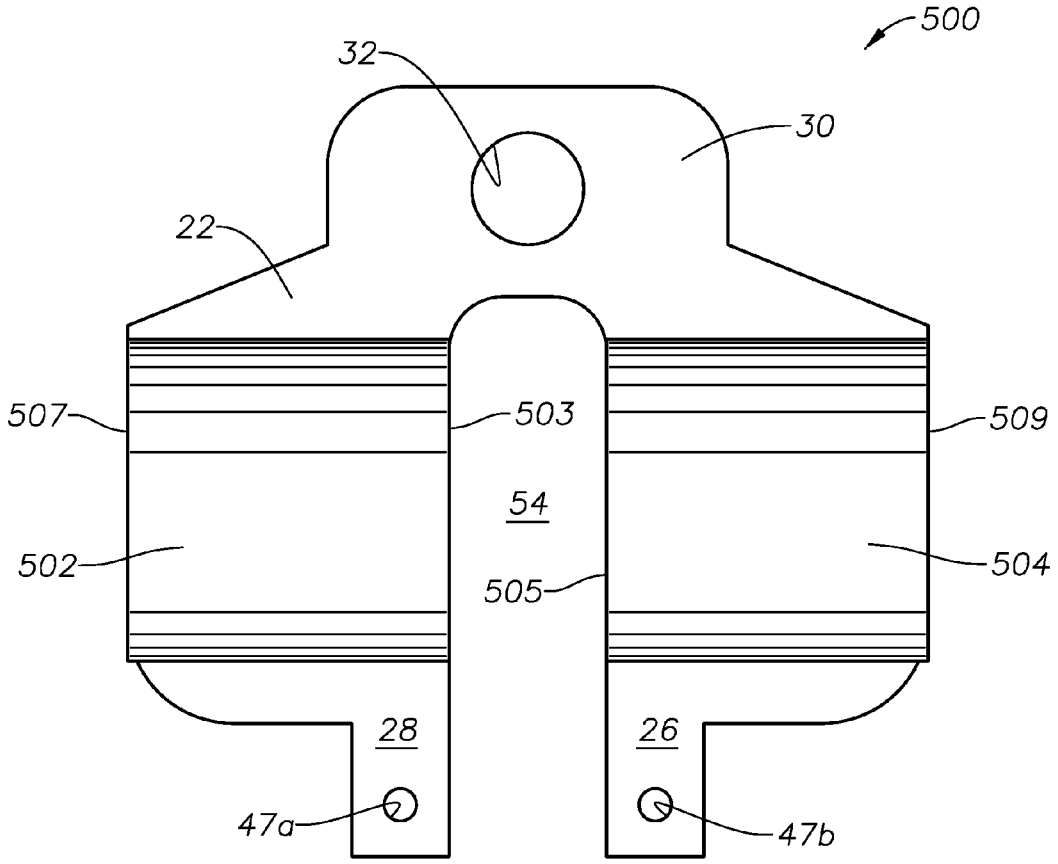
FIG. 10 is a side elevation view of the embodiment of FIG. 9.

FIG. 8 illustrates schematically another embodiment 400 of upper section 22, illustrating formed slots 56*a*, 56*b*, 58*a*, and 58*b*, defining generally horizontal hand holds 57, 59. Also provided are a series of formed through holes 61 (12 total illustrated in embodiment 400, although this number could vary up or down) allowing a pair of hand guards 502, 504 (FIGS. 9, 10) to be attached using threaded bolts 506, 508 (FIG. 9). A pair of through holes 47*a*, 47*b* are provided for attachment of embodiment 400 to lower section 24 (not illustrated in FIGS. 8-10). The dimensions of lengths, angles, and radii illustrated in FIGS. 8-10 are typical and not meant to be limiting in any way. Length dimensions to be noted are designated by the following designations: A', B', C', D', E', F', G', H, I, J, K, M, N, O, P, Q, R, S, T, U, V, W, X, Y, and Z, where Z is the thickness of the entire embodiment 400, which is preferably 0.5 inch, but could be thicker or slightly thinner, depending on the strength requirements. Furthermore, although the preferred metal for embodiment 400 is aluminum, other metals and/or metal alloys could be used. Aluminum is preferred for its low weight, although billet aluminum may be preferred for its strength and may weigh more than cast aluminum. Angle "α" is noted in embodiment 400 to be 112.5 degrees, but angle α could vary from 90 to about 135 degrees. Furthermore, the diameter of attachment holes 61 is noted in embodiment 400 to be 0.25 inch (at 61*a*), but this dimension may vary, as may the number of such attachment holes.

Still referring to FIG. 8 and embodiment 400, the various dimensions and their ranges may be as listed in Table 1, acknowledging that dimensions outside of these ranges may be acceptable:

TABLE 1

Dimensions of Embodiment 400

| Dimension | Embodiment 400 (inch) | Preferred Range (inch) |
|---|---|---|
| A' | 10.551 | 5-25 |
| B' | 2.724 | 1-10 |
| C' | 1.500 | 0.5-5 |
| D' | 3.000 | 1-10 |
| E' | 15.000 | 10-30 |
| F' | 7.500 | 5-15 |
| G' | 1.899 | 1-5 |
| H | 2.100 | 1-5 |
| I | 5.500 | 2-10 |
| J | 1.685 | 1-3 |
| K | 0.776 | 0.5-2 |
| M | 5.055 | 2-10 |
| N | 0.250 | 0.125-2 |
| O | 3.028 | 1-5 |
| P | 1.000 | 0.25-3 |
| Q | 0.625 | 0.25-3 |
| R | 2.89 | 1-5 |
| S | 4.716 | 2-10 |
| T | 6.500 | 3-15 |
| U | 2.500 | 1-10 |
| V | 2.000 | 1-5 |
| W | 5.000 | 3-20 |
| X | 14.50 | 7-40 |
| Y | 1.500 | 0.5-5 |
| Z | 0.500 | 0.3-3 |
| 61a | 0.250 | 0.125-2 |

FIGS. 9 and 10 illustrate schematic perspective and side elevation views, respectively, of embodiment 500 of upper section 22 of embodiment 400 having two hand guards 502, 504 attached thereto using bolts 506, 508. In embodiment 500, there would be six bolts 506, and six bolts 508, corresponding to the twelve through holes 61 illustrated in FIG. 8. It will be understood that a similar arrangement would be provided for attaching hand guard 504, the bolts not being illustrated for clarity. Hand guards 502, 504, are preferably formed from 0.5-inch aluminum pipe that is split in half and milled to provide threaded holes for receiving bolts 506, 508. Embodiment 500 and equivalents thereof provide a lightweight upper section 22, while providing added protection to workers hands. In other embodiments, one hand guard, say 502 for example, may be attached to the opposite side of upper section 22, so that one hand guard is on each side of upper section 22. In yet other embodiments, hand guards 502, 504 need not be round or cylindrical in shape, but could for example be box-shaped, elliptical, triangular, pyramidal, and the like. The side elevation view of FIG. 10 illustrates a preferred arrangement of hand guards 502, 504, in that their inside edges 503, 505 are substantially co-extensive with edges of central open region 54, and their outer edges 507, 509 are substantially co-extensive with respective outer edges of the upper section 22, but this arrangement is not strictly necessary in all embodiments. For example, one or more edges 503, 505, 507, 509 could be rounded inward to allow easier access to hand holds 57, 59 (FIG. 9), or rounded outward to provide even more hand protection.

The valve in the IBOP, whether a flap valve or dart valve, must stay open at all times during picking up, alignment, and threading onto the working drillpipe. In typical practice, one of the rig workers place their hand on top of the release rod 16 and press's down. This will press release rod 16 down and compress spring 6 under dart 8 holding the valve open. One of the rig workers will tighten the rod lock screw, then the valve is locked open until the rod lock screw is loosened. Once loosened, spring 6 under dart 8 will expand and slam the valve closed. The release rod 16 will not come completely out of the release tool upper section 22 unless a rig worker unscrews release tool body lower section 24 from upper sub 2 of the IBOP. The IBOP valve must be open in case of an emergency so that rig workers can pick up the complete combination IBOP and release tool using the rig hoist and screw the lower sub threads 20 into the working drillpipe. Drilling fluid, drilling mud, production fluid, and perhaps hydrocarbons and solids may be blowing out the side outlet port 50 while the rig workers are screwing the combination IBOP/release tool into the working drillpipe. Once they have the combination in place they release the rod lock screw 62 and let the valve close and stop the flow of fluid.

Thus the apparatus, combinations, and methods described herein provide a quick and safe way of quickly picking up, aligning, and attaching an IBOP to a working drillpipe without extraneous mechanical frames and with significantly reduced risk of injury to rig workers.

Certain method embodiments may include using a mobile offshore drilling unit (MODU). Certain method embodiments may comprise disconnecting an umbilical or other flexible conduit using a quick disconnect (QDC) coupling configured as part of one or more subs 70. Certain subsea method embodiments may include assuring flow of fluid through the IBOP using external wet insulation on at least a portion of the outer IBOP for flow assurance. Certain subsea method embodiments may include assuring flow of fluid through the IBOP using a flow assurance fluid, for example a gas atmosphere in the annulus between the inner and outer body of an insulated IBOP, or hot seawater or other water pumped into the IBOP, or methanol. Certain subsea method embodiments may comprise fluidly connecting a source of hydrate inhibition fluid to the IBOP via one or more subs 70.

Over the past several years, the suitability of using high strength steel materials and specially designed thread and coupled (T&C) connections that are machined directly on the joints at the mill has been investigated. See Shilling et al., "Development Of Fatigue Resistant Heavy Wall Riser Connectors For Deepwater HPHT Dry Tree Risers", OMAE2009-79518. These connections eliminate the need for welding and facilitate the use of materials like C-110 and C-125 metallurgies that are NACE qualified. The high strength may significantly reduce the wall thickness required, enabling an IBOP to be designed to withstand pressures much greater than can be handled by X-80 materials and installed in much greater water depths due to the reduced weight and hence tension requirements. The T&C connections eliminate the need for 3$^{rd}$ party forgings and expensive welding processes—considerably improving apparatus delivery time and overall cost. For onshore use, the release tool and IBOP structural components may be made of 4140HT steel, or equivalent material.

From the foregoing detailed description of specific embodiments, it should be apparent that patentable apparatus, combinations, and methods have been described. Although specific embodiments of the disclosure have been described herein in some detail, this has been done solely for the purposes of describing various features and aspects of the apparatus, combinations, and methods, and is not intended to be limiting with respect to their scope. It is contemplated that various substitutions, alterations, and/or modifications, including but not limited to those implementation variations which may have been suggested herein, may be made to the described embodiments without departing from the scope of the appended claims.

What is claimed is:

1. A modular release tool body for use with inside blowout preventers comprising:

a one-piece, formed, planar metallic upper section having a longitudinal axis, the upper section comprising a pair of longitudinal members defining a central open region, each longitudinal member having a lower end, the longitudinal members joined by a top manipulating end having one or more lifting features formed therein configured to accept one or more manipulators, the one or more formed lifting features positioned such that when the release tool body and an inside blowout preventer connected thereto are lifted by the one or more manipulators, they are configured to allow the release tool body and inside blowout preventer to be moved over, aligned with, and connected with a working drillpipe, and configured to prevent the manipulators slipping off; and a one-piece, formed, tubular metallic lower section removably attached to the upper section having the same longitudinal axis as the upper section, the lower section comprising a threaded end for threadedly mating with an end of an inside blowout preventer;

a central longitudinal bore configured to slidingly accept a release rod;

an upper end formed to accept the lower ends of the longitudinal members of the upper section and retaining members therefore;

the upper end further formed to comprise a central axial extension comprising one or more fluid outlets fluidly connected with the central longitudinal bore, the central axial extension configured to accommodate an internally threaded bore substantially perpendicular to and intersecting the central longitudinal bore, and accept a mating threaded release rod lock screw therein.

2. The modular release tool body of claim 1 wherein the one or more lifting features is a single centered lifting eye formed through the top manipulating end of the upper section.

3. The modular release tool body of claim 1 further comprising one or more formed, elongate slots in each longitudinal member configured to define one or more manipulating handles for a rig worker or mechanical manipulator to grasp the upper section and rotate the release tool and thread the pin end of the lower section into the box end of the inside blowout preventer.

4. The modular release tool body of claim 1 wherein the upper end of the lower section is formed to include a pair of vertical receptacles for the lower ends of the upper section, and wherein the retaining members comprise one or more screws threaded through corresponding threaded bores through the receptacles and lower ends.

5. The modular release tool body of claim 1 wherein the central open region is configured to allow a rig worker or mechanical manipulator to engage a release rod and move the release rod downward, opening a valve in the inside blowout preventer.

6. A modular release tool for use with inside blowout preventers comprising:

a one-piece, formed, planar metallic upper section having a longitudinal axis, the upper section comprising a pair of longitudinal members defining a central open region, each longitudinal member having a lower end, the longitudinal members joined by a top manipulating end having one or more lifting features formed therein configured to accept one or more manipulator cables or chains, the one or more formed lifting features positioned such that when the release tool and an inside blowout preventer connected thereto are lifted by the manipulator cables or chains configured to allow the release tool and inside blowout preventer to be moved over, aligned with, and connected with a working drillpipe, and configured to prevent of slipping off of the manipulator cables or chains; and a one-piece, formed, tubular metallic lower section removably attached to the upper section having the same longitudinal axis as the upper section, the lower section comprising a threaded externally tapered pin end configured to threadedly mate with a box end of an inside blowout preventer;

a central longitudinal bore having diameter configured to slidingly accept a release rod;

an upper end formed to accept the lower ends of the longitudinal members of the upper section and retaining members therefore;

the upper end further formed to comprise a central axial extension comprising one or more fluid outlets fluidly connected with the central longitudinal bore, the central axial extension configured to accommodate an internally threaded bore substantially perpendicular to and intersecting the central longitudinal bore, and accept a mating threaded release rod lock screw therein;

a release rod slidingly positioned in the lower section central bore and dimensioned to be accessible by a rig worker or remotely operated device through the central region of the upper section, the central region having a width substantially larger than diameter of the release rod; and one or more formed, elongate slots in each longitudinal member configured to define one or more manipulating handles for a rig worker or mechanical manipulator to grasp the upper section and rotate the release tool and thread the pin end of the lower section into the box end of the inside blowout preventer.

7. The modular release tool according to claim 6 wherein the one or more lifting features is a single centered lifting eye formed through the top manipulating end of the upper section.

8. The modular release tool according to claim 6 wherein the upper end of the lower section is formed to include a pair of vertical receptacles for the lower ends of the upper section, and wherein the retaining members comprise one or more screws threaded through corresponding threaded bores through the receptacles and lower ends.

9. The modular release tool according to claim 6 wherein the central open region is configured to allow a rig worker or mechanical manipulator to engage a release rod and move the release rod downward, opening a valve in the inside blowout preventer.

10. The modular release tool according to claim 6, further comprising a combination of metallurgy and structural reinforcement such as to prevent failure of the release tool upon exposure to inner pressure up to 10,000 psia.

11. A combination modular release tool and inside blowout preventer for threadedly attaching to a drillpipe, the drillpipe having a threaded end for engaging the inside blowout preventer, the combination comprising an inside blowout preventer having a lower end threadably engageable with the drillpipe threaded end and an upper box end threadably engaged with the modular release tool of claim 6.

12. The combination of claim 11 wherein the one or more lifting features is a single centered lifting eye formed through the top manipulating end of the upper section.

13. The combination of claim 11 wherein the upper end of the lower section is formed to include a pair of vertical receptacles for the lower ends of the upper section, and wherein the retaining members comprise one or more screws threaded through corresponding threaded bores through the receptacles and lower ends.

14. The combination of claim 11 further comprising one or more subsea hot stab ports for subsea ROV intervention and/or maintenance of the inside blowout preventer.

15. The combination of claim 11 comprising one or more ports allowing pressure and/or temperature monitoring inside the inside blowout preventer.

16. The combination of claim 11 further comprising a combination of metallurgy and structural reinforcement such as to prevent failure of the inside blowout preventer and/or release tool upon exposure to inner pressure up to 10,000 psia.

17. The combination of claim 11 further comprising one or more subsea umbilicals fluidly connected to locations on the inside BOP selected from the group consisting of a kill line, a choke line, and both kill and choke lines.

18. The combination of claim 17 wherein one of the umbilicals is fluidly connected to a subsea manifold.

19. A method of easily and safely attaching a combination inside blowout preventer and release tool having a lower threaded end to a threaded end of a working drillpipe, the method comprising the steps of:

(a) assembling the combination of claim 6;

(b) pressing down on a top end of the release rod, moving the release rod down into a position holding a valve of the inside blowout preventer open;

(c) locking the valve open by tightening the release rod lock screw;

(d) lifting the combination of step (c) to a position over the working drillpipe threaded end using the one or more formed lifting features on the release tool;

(e) threading the combination of step (c) onto the working drillpipe and continue turning the combination of step (c) so that the threads of the lower end of the inside blowout preventer thread into the threads of the working drillpipe; and (f) loosening the release rod lock screw, allowing closing of the valve and stopping flow of fluid through the inside blowout preventer.

20. The method of claim 19 wherein the assembling step comprises changing the lower section of the release tool body to match size of the box end of the inside blowout preventer prior to attaching the release tool to the inside blowout preventer.

21. A modular release tool body for use with inside blowout preventers comprising:

a one-piece, formed, planar metallic upper section having a longitudinal axis, the upper section comprising a pair of longitudinal members defining a central open region, each longitudinal member having a lower end, the longitudinal members joined by a top manipulating end having one or more lifting features formed therein configured to accept one or more manipulators, the one or more formed lifting features positioned such that when the release tool body and an inside blowout preventer connected thereto are lifted by the one or more manipulator, they are configured to allow the release tool and inside blowout preventer to be moved over, aligned with, and connected with a working drillpipe, and configured to prevent slipping off of the manipulator; and a one-piece, formed, tubular metallic lower section removably attached to the upper section having the same longitudinal axis as the upper section, the lower section comprising a threaded pin end configured to threadedly mate with a threaded box end of an inside blowout preventer;

a central longitudinal bore of diameter configured to slidingly accept a release rod;

an upper end formed to accept the lower ends of the longitudinal members of the upper section and retaining members therefore;

the upper end further formed to comprise a central axial extension comprising one or more fluid outlets fluidly connected with the central longitudinal bore, the central axial extension configured to accommodate an internally threaded bore substantially perpendicular to and intersecting the central longitudinal bore, and accept a mating threaded release rod lock screw therein; and two or more formed slots in each longitudinal member configured to define one or more generally horizontal manipulating handles for a rig worker or mechanical manipulator to grasp the upper section and rotate the release tool and thread the threaded pin end of the lower section into the threaded box end of the inside blowout preventer.

22. The modular release tool body of claim 21 further comprising hand guards removably attached to each longitudinal member, the hand guards configured to provide protection to a worker's hands or mechanical manipulator when grasping the generally horizontal manipulating handles.

23. The modular release tool body of claim 22 wherein the hand guards are half members of split aluminum pipe attached to the longitudinal members using bolts.

* * * * *